US007891437B2

(12) United States Patent
Keskiniva et al.

(10) Patent No.: US 7,891,437 B2
(45) Date of Patent: Feb. 22, 2011

(54) METHOD FOR BREAKING ROCK

(75) Inventors: Markku Keskiniva, Tampere (FI); Jorma Mäki, Mutala (FI); Erkki Ahola, Kangasala (FI); Mauri Esko, Ikaalinen (FI); Aimo Helin, Tampere (FI)

(73) Assignee: Sandvik Mining & Construction OY, Tampere (FI)

( * ) Notice: Subject to any disclaimer, the term of this patent is extended or adjusted under 35 U.S.C. 154(b) by 0 days.

(21) Appl. No.: 11/663,446

(22) PCT Filed: Sep. 23, 2005

(86) PCT No.: PCT/FI2005/050326

§ 371 (c)(1),
(2), (4) Date: Mar. 22, 2007

(87) PCT Pub. No.: WO2006/032734

PCT Pub. Date: Mar. 30, 2006

(65) Prior Publication Data

US 2008/0000666 A1 Jan. 3, 2008

(30) Foreign Application Priority Data

Sep. 24, 2004 (FI) ..... 20045353

(51) Int. Cl.
*B25D 9/00* (2006.01)

(52) U.S. Cl. ..... 173/1; 173/91; 173/200; 173/204

(58) Field of Classification Search ..... 173/1, 173/91, 200, 204
See application file for complete search history.

(56) References Cited

U.S. PATENT DOCUMENTS

| | | | | |
|---|---|---|---|---|
| 3,431,985 | A * | 3/1969 | Bowen | 173/204 |
| 4,690,225 | A * | 9/1987 | Tupitsyn et al. | 173/200 |
| 6,029,753 | A * | 2/2000 | Kuusento et al. | 173/1 |
| 6,186,246 | B1 * | 2/2001 | Muuttonen et al. | 173/1 |
| 6,454,021 | B1 | 9/2002 | Watanabe | |
| 6,938,702 | B2 * | 9/2005 | Saha et al. | 173/1 |
| 7,013,996 | B2 * | 3/2006 | Keskiniva et al. | 175/135 |
| 7,051,525 | B2 * | 5/2006 | Keskiniva et al. | 60/446 |
| 7,114,576 | B2 * | 10/2006 | Keskiniva | 173/2 |
| 7,139,219 | B2 * | 11/2006 | Kolle et al. | 367/85 |
| 7,322,425 | B2 * | 1/2008 | Keskiniva et al. | 173/1 |
| 2004/0226752 | A1 * | 11/2004 | Keskiniva et al. | 175/135 |

(Continued)

FOREIGN PATENT DOCUMENTS

DE 26 42 133 3/1978

(Continued)

*Primary Examiner*—Brian D Nash
(74) *Attorney, Agent, or Firm*—Drinker Biddle & Reath LLP

(57) ABSTRACT

The invention relates to a method for breaking rock to be drilled in rock drilling, in which method the rock to be drilled is subjected to successive stress pulses via a tool. The method comprises stress pulses being exerted on the rock at a high frequency, and the load proportion calculated on the basis of the values of the frequency and the length ($t_p$) of the stress wave being at least 0.075.

12 Claims, 1 Drawing Sheet

U.S. PATENT DOCUMENTS

2004/0251049 A1* 12/2004 Keskiniva ..... 175/50
2005/0139368 A1 6/2005 Keskiniva et al.
2006/0157259 A1* 7/2006 Keskiniva et al. ..... 173/1
2006/0185864 A1* 8/2006 Keskiniva et al. ..... 173/1
2008/0000666 A1* 1/2008 Keskiniva et al. ..... 173/200
2008/0035705 A1* 2/2008 Menotti ..... 228/102

FOREIGN PATENT DOCUMENTS

GB 2 328 342 2/1999
WO WO 97/26090 7/1997
WO WO 03/095153 11/2003

* cited by examiner

METHOD FOR BREAKING ROCK

CROSS REFERENCE TO RELATED APPLICATIONS

This application is the National Stage of International Application No. PCT/FI2005/050326 filed Sep. 23, 2005, and claims benefit of Finnish Application No. 20045353 filed Sep. 24, 2004.

BACKGROUND OF THE INVENTION

The invention relates to a method for breaking rock to be drilled in rock drilling, in which method the rock to be drilled is subjected to successive stress waves via a tool in such a way that the energy of the stress wave transmitted from the tool to the rock causes the rock to be broken.

In rock drilling or the like, rock is broken by conducting a stress wave to the rock via a tool, such as a drill rod or a drill bit at its end. A stress wave is nowadays typically generated by striking the end of the tool with a percussion piston moving back and forth in a rock drilling machine or percussion device by means of a pressure medium. In rock drilling, both the supply of a stress wave and the rotating of the tool take place simultaneously, but the breaking of the rock material is actually based on the energy of the stress wave transmitted from the tool to the rock.

Typically, about 50 to 80% of the energy content of the stress wave is transmitted to the rock to be broken. The energy transmitted to the rock material causes macro-cracks, breaking of rock material and elastic waves. The energy bound to the elastic waves is lost with regard to the breaking of the rock material. On the other hand, producing macro-cracks is, with regard to breaking, more efficient than crushing of rock material. Due to the macro-cracks, large particles are detached from the rock material, whereas in crushing the rock material is ground completely fine, which requires a large amount of energy. Thus, it would be preferable to generate as large a number of macro-cracks as possible instead of crushing the rock.

Present percussion devices generate stress waves at a low frequency, typically at 20 to 100 Hz, the length of the stress wave being rather short, i.e. about 0.2 to 1.6 m. At the same time, the amplitude and energy content of the stress wave are high. At the highest, the amplitudes are typically 200 to 300 MPa. Because of the amplitude of the stress wave, it has been necessary to design the button bits to be used to withstand a high load level. Therefore, there have to be a large number of rock-breaking buttons in a button bit, and the buttons have to be designed to withstand load peaks. Their shapes are thus disadvantageous with regard to the breaking of rock. Therefore, what is called the penetration resistance of the button bit, expressing the proportion of the force exerted on the rock by the button bit to the penetration of the buttons, is large.

The high energy level combined with the disadvantageous shape of the buttons leads to poor efficiency in breaking and detaching rock. Correspondingly, high stress wave amplitude values result in a short service life of the drilling equipment used, i.e. drill rods and button bits. It would be preferable, in regard of generating macro-cracks, to be able to use what are called aggressively shaped buttons but this is not feasible at the present stress amplitude level. If it were possible to use such buttons, breaking of rock could be made significantly more efficient compared with the present solutions.

In developing present solutions, the focus has generally been in using greater percussions powers and thus using higher stress wave amplitudes than before. Surprisingly, however, it has been noted that the same result can be achieved with the method according to the invention by using, contrary to the present trend, significantly lower stress wave amplitudes than today.

BRIEF DESCRIPTION OF THE INVENTION

An object of the invention is to provide such a method for breaking rock material that results in better efficiency than presently and that increases, at the same time, the durability and service life of the equipment.

The method according to the invention is characterized by stress pulses being exerted on the rock at a high frequency and by the amplitude of the stress waves being low, so that the load proportion calculated on the basis of the values of the frequency and the length of the stress wave is at least 0.075.

An essential idea of the invention is to use a stress wave frequency essentially higher than the present frequencies, and correspondingly stress waves essentially longer than the present stress waves compared with the cycle time of stress waves, whereby the load proportion used for breaking rock can be made essentially higher than the load proportion of the present equipment.

An advantage of the invention is that a stress amplitude lower than the present amplitudes is sufficient for breaking rock with a higher load proportion. Further, an advantage of the invention is that the buttons of button bits do not have to be shaped according to requirements of high stress peaks, but they can be designed at a lower stress level to be more aggressive, so that their breaking effect on the rock is greater than the effect of the present button bits. Further, using lower stress wave amplitudes allows the use of lighter tools, i.e. drill rods and other devices, than before, while at the same time the service life of the tools can be lengthened.

BRIEF DESCRIPTION OF THE FIGURES

The invention will be described in more detail in the attached drawings, in which.

DETAILED DESCRIPTION OF THE INVENTION

Figure 1:
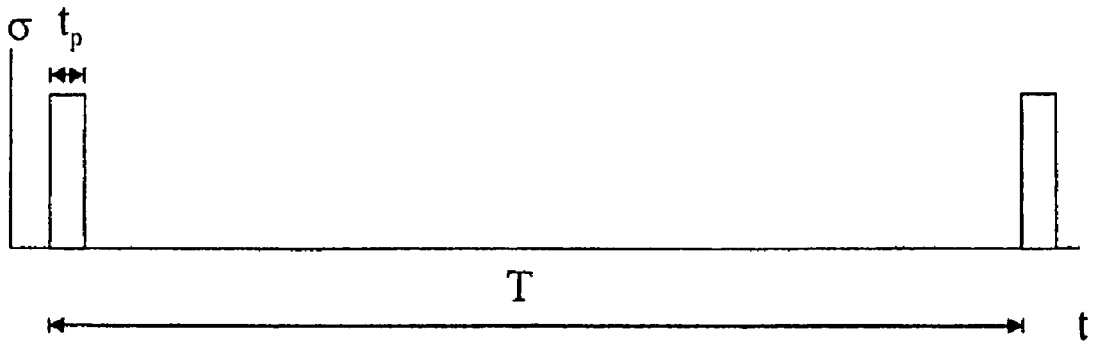
FIG. 1 shows schematically and timewise stress pulses of present percussion devices.

FIG. 1 shows schematically and timewise in relation to each other stress waves provided by a percussion device functioning according to prior art. The vertical axis shows the stress amplitude σ of stress waves, and the horizontal axis shows time t. As seen from FIG. 1, the length $t_p$ of a stress wave is rather short compared with the cycle time T between two stress waves. This is based on the stress wave being generated by a stroke of a percussion piston on a drill rod, which action is proportional to the length of the percussion piston, and therefore fairly short. Due to the reciprocating motion of the percussion piston, the percussion frequency is nowadays typically about 20 to 100 Hz, whereby the length in time of the stress wave provided by the stroke compared with the time between successive strokes is very short. The amplitude σ of the stress wave generated simultaneously is typically high, i.e. 200 to 300 MPa.

Figure 2:
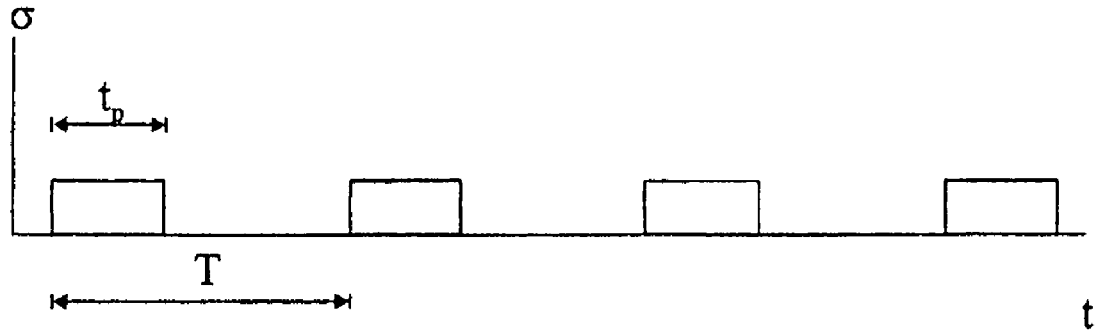
FIG. 2 shows, in the same way as in FIG. 1, stress pulses of a percussion device applying the method of the invention.

FIG. 2, in turn, illustrates stress waves generated with the method according to the invention. In this solution according to the invention, it can be noted that the amplitude of the stress wave compared with the stress wave of FIG. 1 is significantly lower. Since in the method of the invention the frequency of the stress waves is essentially higher than in known solutions, the length $t_p$ of the stress wave compared with the time T between stress waves is significantly greater than in known solutions.

The term "load proportion α" in breaking rock defines how the rock to be broken is loaded timewise. This can be expressed with the equation $$\alpha = \frac{t_p}{T} = t_p f = \frac{L_p f}{c}. \tag{1}$$

where $t_p$ is length of the stress wave, f is frequency, $L_p$ is wavelength and c is speed of the stress wave in the tool. With present percussion devices a typical load proportion α=0.01 to 0.025.

For example with percussion devices having a piston length of 0.5 m and a frequency of 60 Hz, the load proportion is 0.012.

With the method according to the invention, a significantly higher load proportion is achieved, whereby α=>0.075, preferably at least 0.1.

In theory the maximum of the load proportion is 1, but in practice it cannot be 1. Part of the time of the device generating a stress wave goes to the actual generating of the stress wave and part of time to returning, i.e. moving to the position for generating a stress wave. In practice, this means that since the returning speed cannot, in reality, be greater than the generating speed of a stress wave, the maximum load proportion is in practice approximately 0.5.

Energy W and power P, which are supplied via a tool from the percussion device to the material to be broken, such as rock, may be defined for rectangular stress pulses by means of the equations $$W = \frac{A_k c}{E_k} t_p \sigma^2 \tag{2}$$

$$P = W f = \frac{A_k c}{E_k} t_p \sigma^2 f = \frac{A_k c}{E_k} \alpha \sigma^2, \tag{3}$$

where $A_k$ is the cross-sectional area of the tool used, i.e. a drill rod, and $E_k$ is the value of the elastic modulus of the same tool.

If it is desirable to use load proportions higher than those of the present devices, stress amplitudes of the present magnitude cannot be used any longer. This would result in significant shortening of the service life of the drilling equipment. Also, button bits provided with aggressive buttons, needed for efficient utilizing of the method, do not withstand present load levels. Further, the percussion power required by the percussion device would increase up to 4 to 10 times from what it is now.

The load proportion can be increased by, for example, increasing the frequency of stress waves. By applying this principle, the amplitude of a stress wave can be dimensioned utilizing the uniformity of the percussion powers by means of the equation $$\sigma = \sigma_{refe} \sqrt{\frac{\alpha_{refe}}{\alpha}} \tag{4}$$

where $\sigma_{refe}$ is a reference amplitude, i.e. a typical stress level with present percussion devices, and $\alpha_{refe}$ is a corresponding reference load proportion. If the highest stress value in use today, i.e. 300 MPa, is selected as the reference amplitude $\sigma_{refe}$, and 0.025 is selected as the load proportion $\alpha_{refe}$, the maximum amplitude will be $$\sigma < \sqrt{\frac{0.025}{\alpha}}\, 300 MPa. \tag{5}$$

According to the invention, a stress wave frequency is used that is essentially higher than in present solutions, i.e. at least 250 Hz, preferably more than 350 Hz, for example 350 to 1 000 Hz.

When the load proportion is at least 0.075 at the above frequencies, an efficient drilling result is achieved with the method according to the invention by having 150 MPa as the maximum amplitude. Even lower amplitudes yield good results, but breaking rock still clearly requires a considerably high amplitude level. In practice, it has been noted that the advantages of the method according to the invention begin to show when the stress amplitude is about 25 MPa, but preferably when the stress amplitude is about 40 MPa or higher.

Figure 3:
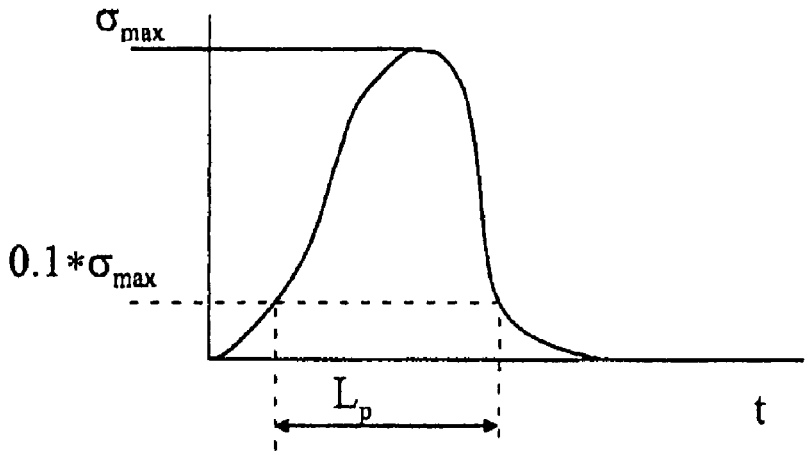
FIG. 3 shows schematically a stress wave.

In present devices having a percussion piston the stress wave is, in theory, nearly of a shape of a rectangular pulse, and its length has been defined to be twice the length of the percussion piston. If the stress wave is generated in ways other than striking the tool with a percussion piston, its shape may considerably deviate from the rectangular shape, for instance in the way shown by FIG. 3. In this case, the amplitude of the stress wave refers to, in the manner indicated by FIG. 3, the maximum value $\sigma_{max}$ of the amplitude, and its length may be defined substantially in accordance with FIG. 3, so that the length of the stress wave is the time between those points where the stress exceeds the value $0.1 \times \sigma_{max}$ when the stress wave rises and correspondingly where the stress goes below the value $0.1 \times \sigma_{max}$ when the stress wave falls.

Other ways to generate a stress wave include electric or electromagnetic equipment where generation of a stress wave is based on, for example, the length of the electric current supplied or the length of the pulse of pulse-like electric current. Yet other ways to generate a stress wave include solutions where a stress wave is generated by charging energy by means of the pressure of a pressure fluid, for instance by charging energy to stress elements and by releasing it as compressive energy to the tool, or where a stress wave is generated by subjecting the tool directly to the compressive force provided by the pressure of a pressure fluid. Thus, in an embodiment, the compressive force is generated by causing the pressure of the pressure fluid to directly or indirectly affect the end of the tool for the period of time of generating the stress pulse in such a way that the force generated by the pressure compresses the tool. In all of these alternatives, the stress wave is preferably generated by periodically subjecting the tool, such as a drill rod, to a compressive force without a stroke by a percussion piston, so that the compressive force generates a stress wave in the tool during the time it affects there. Thus, when the method is applied, the frequency and the length of the stress waves are adjusted by adjusting the effective frequency and effective time of the compressive force on the tool.

The invention has been explained in the above description and drawings only by way of example, and it is by no means restricted to them. What is essential is that the frequency of the stress waves is significantly higher than present percussion frequencies, that the load proportion provided by the stress wave is significantly greater than that provided by present devices, and that the amplitude of the stress is significantly lower than the amplitudes of present stress waves.

The invention claimed is:

1. A method for breaking rock to be drilled in rock drilling, in which method the rock to be drilled is subjected to successive stress pulses by using the pressure of a pressure fluid via a tool in such a way that the energy of the stress wave transmitted from the tool to the rock causes the rock to be broken, wherein the stress waves being generated by subjecting the tool periodically to compressive force so that the compressive force generates a stress wave in the tool, the compressive force being generated by causing the pressure of the pressure fluid to directly or indirectly affect the end of the tool for the period of time of generating the stress pulse in such a way that the force generated by the pressure compresses the tool, the stress pulses being exerted on the rock at a high frequency and by a load proportion of at least 0.075, wherein the load proportion is determined based on the frequency and the length of time to which the compressive force is applied to the tool during each application of the compressive force, wherein the frequency of the stress waves is at least 250 Hz and the amplitude of the stress waves is at least 25 MPa.

2. A method according to claim 1, wherein the load proportion ($\alpha$) being at least 0.1.

3. A method according to claim 2, wherein the amplitude of the stress waves is less than about 150 MPa.

4. A method according to claim 1, wherein the amplitude of the stress waves is less than about 150 MPa.

5. A method according to claim 1, wherein the frequency and the length of the stress waves is adjusted by adjusting the effective frequency and effective time of the compressive force on the tool.

6. A method according to claim 1, wherein the frequency of the stress waves is at least 350 Hz.

7. A method according to claim 1, wherein the amplitude of the stress waves is at least 40 MPa.

8. A method according to claim 1, wherein the tool is a drill rod.

9. A method of breaking rock, comprising:

generating a stress wave in a tool by periodically applying a pressure of a pressure fluid to an end of a tool to compress the tool with a frequency of applying the pressure and a length of time the pressure is applied during each application, to produce a stress wave having a load proportion ($\alpha$) of at least 0.075; and transmitting the generated stress wave to a rock to be drilled in a series of stress pulses, wherein the frequency of the stress waves is at least 250 Hz and the amplitude of the stress waves is at least 25 MPa.

10. A method according to claim 9, wherein the load proportion is:

$$\alpha=t_p f$$

wherein $t_p$ is the length of the stress wave and f is the frequency.

11. A method according to claim 9, wherein the load proportion ($\alpha$) is at least 0.1.

12. A method for breaking rock to be drilled in rock drilling, in which method the rock to be drilled is subjected to successive stress pulses by using the pressure of a pressure fluid via a tool in such a way that the energy of the stress wave transmitted from the tool to the rock causes the rock to be broken, wherein the stress waves being generated by subjecting the tool periodically to compressive force so that the compressive force generates a stress wave in the tool, the compressive force being generated by causing the pressure of the pressure fluid to directly or indirectly affect the end of the tool for the period of time of generating the stress pulse in such a way that the force generated by the pressure compresses the tool, the stress pulses being exerted on the rock at a high frequency and by a load proportion ($\alpha$) of at least 0.075 as calculated according to the equation:

$$\alpha=t_p f$$

wherein $t_p$ is the length of the stress wave and f is the frequency, wherein the load proportion is determined based on the frequency and the length of time to which the compressive force is applied to the tool during each application of the compressive force, wherein the frequency of the stress waves is at least 250 Hz and the amplitude of the stress waves is at least 25 MPa.

* * * * *